US007044869B2

(12) United States Patent
Mauser et al.

(10) Patent No.: US 7,044,869 B2
(45) Date of Patent: May 16, 2006

(54) RACKET FOR BALL GAMES AND PRODUCTION PROCESS

(75) Inventors: Johannes Mauser, Bregenz (AT); Klaus Rambach, Peiting (DE); Manfred Emberger, Lochau (AT); Johan Kotze, Bregenz (AT); Herfried Lammer, Lauterach (AT)

(73) Assignee: Head Technology GmbH, Kennelbach (AT)

( * ) Notice: Subject to any disclaimer, the term of this patent is extended or adjusted under 35 U.S.C. 154(b) by 102 days.

(21) Appl. No.: 10/812,067

(22) Filed: Mar. 30, 2004

(65) Prior Publication Data

US 2005/0164813 A1 Jul. 28, 2005

(30) Foreign Application Priority Data

Jan. 23, 2004 (DE) ..... 10 2004 003 528

(51) Int. Cl.
*A63B 49/02* (2006.01)

(52) U.S. Cl. ..... 473/524; 473/537

(58) Field of Classification Search ..... 473/524, 473/535–537, 547

See application file for complete search history.

(56) References Cited

U.S. PATENT DOCUMENTS

| | | | | |
|---|---|---|---|---|
| 1,451,836 | A * | 4/1923 | Larned | 473/545 |
| 3,647,211 | A | 3/1972 | Doessel et al. | |
| 3,917,267 | A | 11/1975 | McGrath | |
| 4,353,551 | A | 10/1982 | Arieh et al. | |
| 5,014,987 | A * | 5/1991 | Soong | 473/537 |
| 5,152,526 | A * | 10/1992 | Soong | 473/537 |
| 5,573,242 | A * | 11/1996 | Yoo | 473/521 |
| 6,447,412 | B1 * | 9/2002 | Filippini | 473/524 |
| 6,761,651 | B1 * | 7/2004 | Pai | 473/545 |
| 2002/0058557 | A1 | 5/2002 | Kanemitsu | |
| 2003/0060312 | A1 | 3/2003 | Pai | |
| 2005/0164812 | A1 * | 7/2005 | Mauser et al. | 473/524 |
| 2005/0164813 | A1 * | 7/2005 | Mauser et al. | 473/524 |

FOREIGN PATENT DOCUMENTS

| | | |
|---|---|---|
| DE | 39 10 890 C2 | 10/1989 |
| FR | 821 471 | 12/1937 |

* cited by examiner

*Primary Examiner*—Raleigh W. Chiu
(74) *Attorney, Agent, or Firm*—Finnegan, Henderson, Farabow, Garrett & Dunner LLP

(57) ABSTRACT

The present invention relates to an improved racket for ball games, in particular a tennis racket, squash racket, badminton racket, racquet ball racket or paddle tennis racket, comprising a frame consisting of a racket head and a handle portion connected thereto and being formed of a frame profile, wherein the racket head defines a stringing plane. The frame profile comprises at least one opening extending through the frame profile essentially perpendicular with respect to the stringing plane of the racket. Preferably, at least two openings of this kind are provided essentially symmetrical with respect to the longitudinal axis of the racket at about two o'clock to four o'clock and/or eight o'clock to ten o'clock on the racket head. Particularly preferably, the openings are at about three o'clock and/or nine o'clock. The racket of the present invention thus exhibits particularly advantageous ball control characteristics.

26 Claims, 2 Drawing Sheets

RACKET FOR BALL GAMES AND PRODUCTION PROCESS

RACKET FOR BALL GAMES AND PRODUCTION PROCESS

Figure 1A:
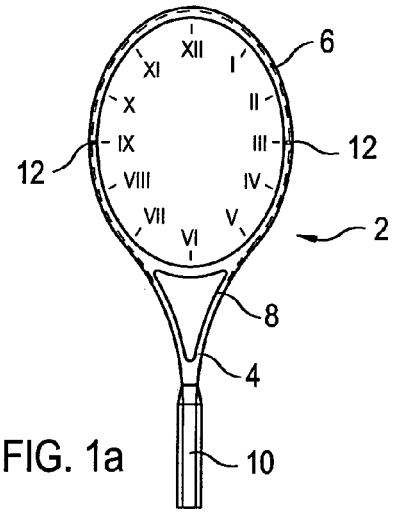

The present invention relates to a racket for ball games, in particular a tennis racket, squash racket, badminton racket, racquet ball racket or paddle tennis racket having excellent handling properties, as well as a process for producing such a racket.

Rackets of this kind typically have a frame forming a racket head and a grip or handle portion connected thereto. A so-called heart region is typically formed in the transition area between the racket head and the handle portion. The frame is usually formed of a frame profile or hollow profile which is often produced of a carbon fiber reinforced plastics material in a molding press. The racket head of the racket defines a stringing plane in which the stringing of the racket is arranged. For receiving the individual strings of the stringing, through holes through which the individual strings can be passed are provided on the frame in the stringing plane.

It is the object of the present invention to improve a racket of the above-identified kind with respect to its handling characteristics, in particular its ball control, wherein at the same time a light-weight construction of the racket is possible. This object is achieved with a racket comprising the features of independent claim 1. The dependent claims describe preferred embodiments of the racket of the present invention. Independent process claim 16 relates to a process for producing a racket of this kind. The claims depending thereon relate to advantageous embodiments of the process of the present invention.

The ball game racket of the present invention comprises a frame which is formed of a frame profile or hollow profile and has a racket head and a handle portion being connected thereto preferably via a heart region. The racket head defines a stringing plane. The frame profile comprises at least one opening extending through the frame profile and essentially perpendicular with respect to the stringing plane. In other words, the opening in the frame profile of the racket of the present invention extends essentially perpendicular with respect to the through holes which are usually provided in the frame profile and serve for passing through strings. The opening can be provided such that it is arranged between two neighboring through holes for the strings. However, it can also be advantageous to provide the opening in the area of a through hole for the string because thus it is possible, e.g., to fix a cover for the opening by means of the string and/or an eye (grommet) for the string.

The shape of the racket head is to a great extend arbitrary and can be oval, egg-shaped, drop-shaped or rectangular with rounded edges. For defining the position of the openings along the circumference of the racket head, usually the dial of a clock is used, wherein the twelve o'clock position is located at the outermost or free end of the racket head (cf. FIG. 1*a*). The three o'clock position and nine o'clock position are accordingly located approximately in the middle of the overall length of the racket head.

The openings are preferably provided in pairs essentially symmetrical with respect to the longitudinal axis of the racket, i.e. two, four, six or more openings can be provided symmetrical with respect to the longitudinal axis of the racket. The at least one opening is preferably arranged in the area between two o'clock and four o'clock and/or between eight o'clock and ten o'clock on the racket head. Particularly preferably, the openings are arranged in pairs in this area. More preferably, at least one pair of openings is provided at about three o'clock and/or nine o'clock on the racket head. Moreover, it can be advantageous to provide a plurality of openings per side. For example, a plurality of openings can be arranged symmetrically around the three o'clock and/or nine o'clock positions, or starting from three o'clock and/or nine o'clock towards the handle portion, or starting from three o'clock and/or nine o'clock towards the free end of the racket head.

According to the present invention, the opening provided perpendicular with respect to the stringing plane extends completely through the frame profile, i.e. in case of a hollow profile, a first hole is provided at a first racket side and, in alignment therewith, a second hole is provided at the opposite second racket side, wherein both holes together form the opening.

The opening is preferably made in the frame after the racket was molded in the molding press, however, it can also be made during the molding process by placing a core into the mold. If the opening is made after the molding process, this is preferably done by drilling, milling or sawing.

In case the opening is made by drilling, its cross-section is usually circular cylindrical, but it can also have any other shape. A circular opening has preferably a diameter ranging between 2 mm and 8 mm, more preferably between 3 mm and 6 mm. In the case of an opening made by milling or sawing, the two opposite holes in the frame profile are usually made independent of one another, wherein each hole is essentially bow-shaped or trough-shaped when being viewed from a direction parallel to the stringing plane. However, the holes can also have any other shape. The length of each of the holes along the frame is preferably ranging between 1 mm and 10 mm, more preferably between 3 mm and 7 mm. The depth of each hole corresponds at least to the wall thickness of the frame profile.

The widths of the holes, i.e. their dimensions in the direction of the through holes for the strings or perpendicular with respect to the frame at the corresponding positions preferably range between 3 mm and 7 mm. The dimensions of the hole, in particular its width and depth, should be selected such that the hole does not reach a groove provided in the frame for receiving a head band.

In order to prevent dirt and/or moisture from entering the frame profile, the opening is preferably provided with an essentially tubular insert so that the frame profile is closed towards the interior. This tubular insert is usually made of an elastic material (e.g. rubber) so that the effects caused by the provision of the opening are influenced as little as possible. It is also possible to cover the holes forming the opening with a separate cover made of an elastic material, which leads to the same effect.

Moreover, it can be preferred to reinforce the frame profile in the area around the at least one opening by providing reinforcing or strengthening layers. Particularly advantageous for this purpose are strengthening layers of woven materials made of carbon fiber, glass or aramid and/or a unidirectional prepreg, which are each arranged at an angle of ±45° with respect to the longitudinal direction of the frame profile (i.e. spirally in the wall of the frame profile).

It is a particular effect of the openings which extend perpendicular with respect to the stringing plane that during a stroke the racket has relatively stiff characteristics in the moment the ball hits the racket so that the ball is accelerated in an excellent manner, while after the ball has left the racket, the racket has rather soft or dampened characteristics. The effect of the present invention can be improved even further by providing the frame profile in the area of the opening preferably on both sides with a trough-shaped depression whose depth extends parallel with respect to the opening.

It is a further advantage of the racket of the present invention that vibrations in the racket caused by the ball contact are much less strongly led to the handle than in known rackets, which in particular leads to an improved ball control during the game and to an improved dampening of the racket, so that appearances such as the tennis elbow can be minimized or eliminated.

Figure 1B:
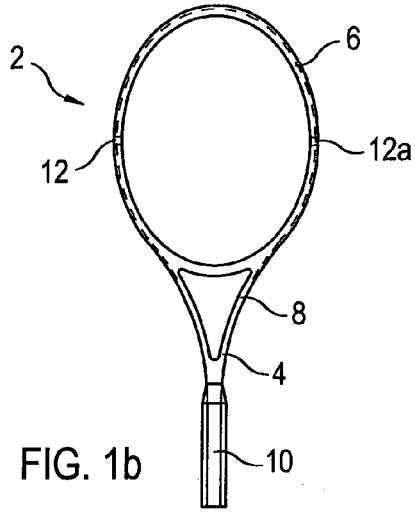
Figure 2A:
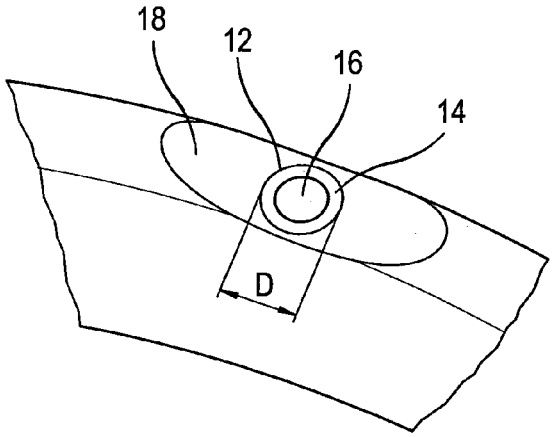
Figure 2C:
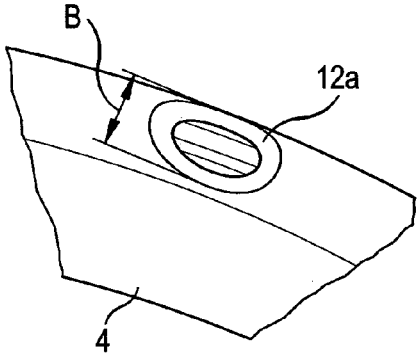
Figure 2B:
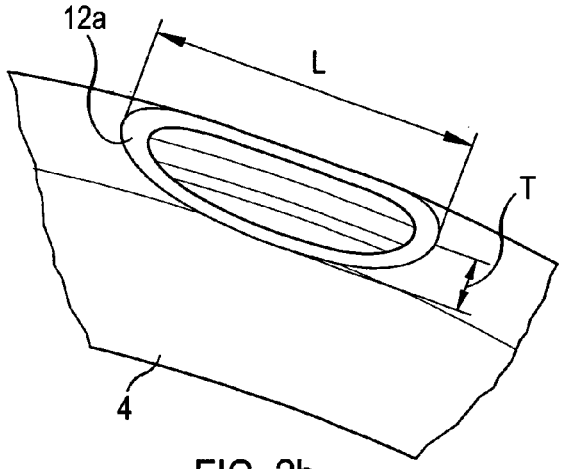

In the following, the racket of the present invention will be described exemplarily on the basis of preferred embodiment and with reference to the drawings in which FIG. 1*a* shows a schematic front view of a first embodiment of a racket of the present invention;

FIG. 1*b* shows a schematic front view of a second embodiment of a racket of the present invention;

FIG. 2*a* shows an enlarged perspective view of an area of the frame of a racket of the present invention according to FIG. 1*a* comprising a circular cylindrical opening and a trough-shaped depression;

FIG. 2*b* shows an enlarged perspective view of an area of the frame of a racket of the present invention according to FIG. 1*b* comprising an opening formed by two separate opposite holes, wherein one of these holes is visible;

FIG. 2*c* shows an enlarged perspective view of an area of the frame similar to that of FIG. 2*b*, wherein the hole is shorter than in the embodiment shown in FIG. 2*b;*

Figure 2D:
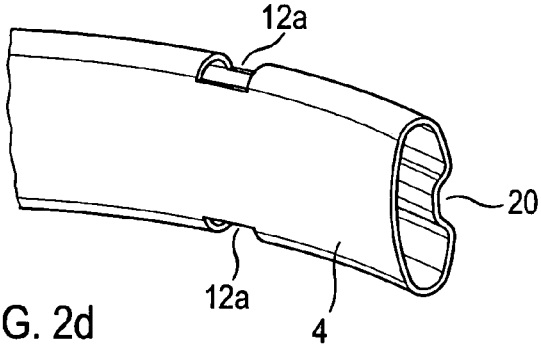
Figure 3C:
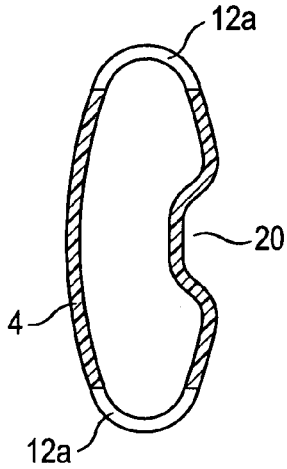
Figure 3B:
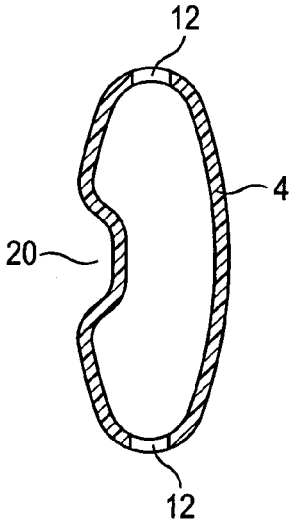
Figure 3A:
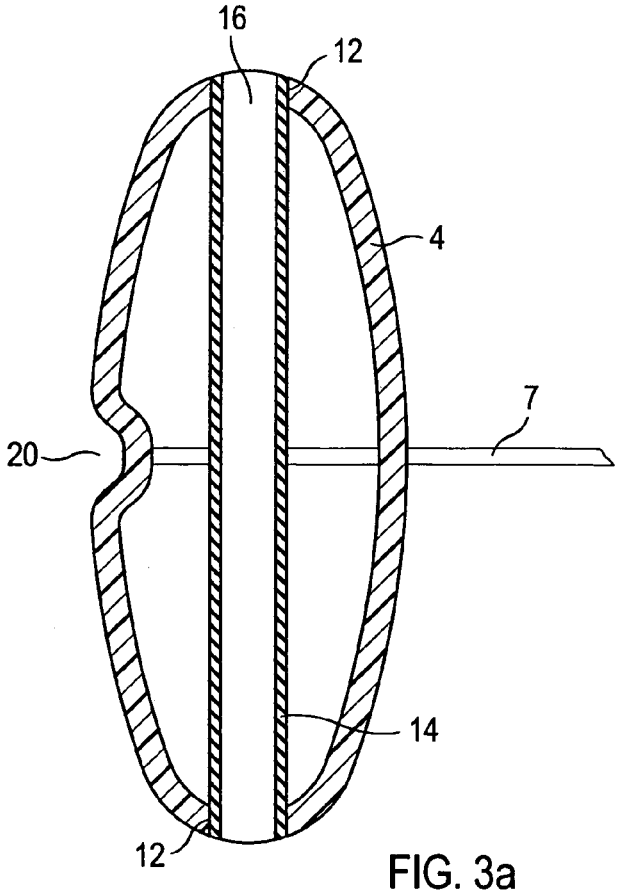

FIG. 2*d* shows a perspective partial view of an area of the frame of a further embodiment of the racket of the present invention, wherein the opposite holes have an essentially rectangular cross-section;

FIG. 3*a* shows a schematic cross-sectional view of the frame profile of a frame of the present invention according to the embodiment shown in FIG. 2*a*, however without a trough-shaped depression;

FIG. 3*b* shows a schematic cross-sectional view of the frame profile of a frame of the present invention similar to that of FIG. 3*a*, however without a tubular insert; and FIG. 3*c* shows a schematic cross-sectional view of a frame profile of a racket of the present invention according to the embodiment shown in FIG. 2*d*.

For a better understanding, the schematic representation of the racket 2 of the present invention shown in FIG. 1*a* contains a dial of a normal clock, wherein the twelve o'clock position (XII) is located at the outermost, free end of the racket.

The racket of the present invention comprises a frame 4 forming a racket head 6 and a handle portion 10 connected thereto preferably via a heart region 8. The frame 4 is made of a frame profile or hollow profile (cf. FIGS. 2*d* and 3*a*–3*c*). The racket head defines a stringing plane of the racket. For receiving the stringing, the frame 4 comprises in the area of the racket head 6 a plurality of through holes (not shown) lying essentially in the stringing plane and serving for passing through them individual strings 7 of the stringing. In the cross-sectional view of FIG. 3*a*, one of these strings is schematically shown.

According to the embodiment shown in FIG. 1*a*, the frame profile comprises at three o'clock and/or at nine o'clock an opening 12 extending through the frame profile and essentially perpendicular with respect to the stringing plane and/or the through holes for the strings of the stringing. As shown in detail in FIG. 2*a*, this opening is shaped as an essentially circular cylindrical through hole. The hole extends through the two opposite walls of the frame profile and thus forms an opening 12 extending through the frame profile. The circular opening 12 has preferably a diameter D ranging between about 2 mm and 8 mm, more preferably between 3 mm and 6 mm.

In order to prevent dirt and/or moisture from entering the interior of the frame profile, the opening 12 is preferably provided with an insert 14 which closes the frame profile towards the interior of the opening. This insert 14 is preferably tubular, i.e. has a through hole 16. However, it can also be configured as a "cover" or as a solid profile. The insert 14 is typically made of a soft or elastic material, so that it does not considerably influence the properties of the racket in this area. Preferably a transparent plastics material (e.g. rubber) is used. The tubular insert 14 has preferably a thin wall having a thickness of, e.g., about 0.5 to 1.5 mm, preferably about 0.5 to 1 mm. FIG. 3*b* shows a cross-sectional view of the racket of the present invention without an insert.

As shown in FIG. 2*a*, the racket of the present invention can have a trough-shaped depression 18 in the area of the opening 12. The frame preferably comprises one depression 18 of this kind on each of the two opposite sides of the frame 4, i.e. the frame height is reduced in this area by two times the depth of each of the trough-shaped depressions 18. More preferably, the racket of the present invention comprises four trough-shaped depressions 18 of this kind, namely two per opening 12 on opposite sides. The opening 12 and optionally the corresponding depression(s) 18 are preferably provided in the area between two o'clock and four o'clock and between eight o'clock and ten o'clock of the racket. Particularly preferably, one opening 12 is provided on the frame 4 at about three o'clock and another at about nine o'clock. In the latter case it is preferable to provide both at three o'clock and at nine o'clock a trough-shaped depression 18 at both the front and back sides of the racket.

The trough-shaped depression is preferably molded into the frame profile during the step of molding the racket frame in a molding press, for example by providing a corresponding protrusion in the mold. Moreover, it might be preferable to provide in the area of the opening 12 one or more strengthening layer(s) in the material forming the frame profile—independent of whether an depression 18 is present or not. For this purpose, for example a carbon fiber material, a woven material made of glass or aramid and/or a unidirectional prepreg can be incorporated into the frame profile forming the racket frame at an angle of ±45° with respect to the longitudinal direction of the frame profile (i.e. spirally in the wall of the frame profile). This is preferably done by stacking the different layers of frame material and strengthening material and subsequently rolling the stacked materials to form a "tube" which is then placed in the molding press and pressed under the influence of temperature and pressure to form the frame.

It can be taken from the embodiments shown in FIGS. 2*b* and 2*c* that there is a further way of providing the opening 12 in the frame 4 of the racket 2 of the present invention, namely by providing, instead of a through hole through the frame profile, both the front and back sides of the frame with individual holes 12*a*. FIGS. 2*b* and 2*c* both show only one hole 12*a* of this kind, while a corresponding hole in the opposite side of the frame is not shown. Two opposite holes 12*a* together form an opening extending through the frame profile.

It is shown in FIGS. 2*b* and 2*c* that the holes 12*a* are essentially bow-shaped or trough-shaped when being viewed in a direction parallel to the stringing plane. This can be realized, e.g., by milling or sawing. In the embodiment according to FIG. 2*c*, the length L of the holes 12*a* along the frame preferably ranges between 1 mm and 10 mm, more preferably between 3 mm and 7 mm. The greatest depth T of a hole 12*a* corresponds to at least the wall thickness of the frame profile so that the frame profile is at least in parts removed completely in order to expose an opening into the interior of the frame profile. The practicable maximum depth of the hole 12*a* is preferably the depth up to a groove 20 (FIG. 3*c*) for receiving the head band of the racket. The width B of the hole 12*a* preferably ranges between 3 mm and 7 mm. Although it is not shown in FIGS. 2*b* and 2*c*, it is preferred also in these embodiments to provide the opening with an (preferably essentially tubular) insert or cover whose shape can be adapted to the shape of the hole or trough so that neither dirt nor moisture can enter the interior of the frame profile.

FIGS. 2*d* and 3*c* show a further embodiment of the racket of the present invention which is similar to the embodiments shown in FIGS. 2*b* and 2*c*. In accordance with this embodiment, the opposite holes 12*a*, which together form the opening, have an essentially rectangular cross section when being viewed in a direction parallel to the stringing plane.

In addition to the embodiments shown in the Figures, it is of course also possible to provide, along the frame, a plurality of openings 12 which extend essentially perpendicular with respect to the stringing plane of the racket. For example, a plurality of openings can be arranged symmetrically around three o'clock and/or nine o'clock, or starting from three o'clock and/or nine o'clock towards the handle portion, or starting from three o'clock and/or nine o'clock towards the free end of the racket head.

The racket of the present invention is particularly advantageous with respect to its improved ball control. Moreover, vibrations caused when striking the ball are less strongly led to the handle than in known rackets. At the same time, however, the acceleration ability which the racket of the present invention can transfer to the ball is improved. The advantageous properties of the racket of the present invention are probably due to the fact that the outermost wall of the frame profile, i.e. the part of the wall of the frame profile having the greatest distance from the stringing plane, is weakened by the opening in the area between two o'clock and four o'clock or between eight o'clock and ten o'clock so that here a bending resistance moment of the frame profile is considerably lower than in the areas without an opening. So far, such a weakening of the frame profile has been considered to be non realizable because it has been assumed that the frame would necessarily fracture due to the stress caused when playing with the racket. In accordance with the invention, however, it turned out that these openings not only allow a very good ball control but at the same time guarantee the required stability of the racket.

Due to the opening(s) provided in the frame, in particular in case of two openings arranged symmetrical with respect to the longitudinal axis of the racket, a kind of "joint" (control point) is formed in the area of the openings, i.e. the racket can be extremely flexible so that the particularly advantageous properties are achieved.

The invention claimed is:

1. A racket for ball games including a frame having a racket head and a handle portion connected thereto and being formed of a hollow frame profile, wherein the racket head defines a stringing plane and the frame profile comprises at least one opening extending through the frame profile and essentially perpendicular with respect to the stringing plane of the racket, wherein the at least one opening is formed by two opposite holes in the hollow frame profile.

2. The racket according to claim 1, wherein the frame comprises a plurality of through holes lying essentially in the stringing plane for passing through them the individual strings of the stringing.

3. The racket according to claim 1, wherein at least two openings are provided essentially symmetrical with respect to a longitudinal axis of the racket.

4. The racket according to claim 1, wherein the at least one opening is provided in the area between two o'clock and four o'clock or between eight o'clock and ten o'clock on the racket head.

5. The racket according to claim 1, wherein the at least one opening is provided at about three o'clock or about nine o'clock-on the racket head.

6. The racket according to claim 1, wherein the at least one opening is formed as a through hole.

7. The racket according to claim 6, wherein the through hole is cylindrical.

8. The racket according to claim 7, wherein the diameter (D) of the through hole ranges between 2 mm and 8 mm.

9. The racket according to claim 8, wherein the diameter (D) of the through hole ranges between 3 mm and 6 mm.

10. The racket according to claim 7, wherein the through hole is circular cylindrical, elliptical or rectangular cylindrical.

11. The racket according to claim 1, wherein each of the holes is essentially trough-shaped when it is viewed in the direction of the stringing plane.

12. The racket according to claim 1, wherein the length (L) of each of the holes along the frame profile ranges between 1 mm and 10 mm.

13. The racket according to claim 12, wherein the length (L) of each of the holes along the frame profile ranges between 3 mm and 7 mm.

14. The racket according to claim 1, wherein each of the holes has a depth (T) corresponding to at least the wall thickness of the frame profile and extending maximally up to a groove for receiving a head band.

15. The racket according to claim 1, wherein the at least one opening comprises an essentially tubular insert useful for closing the frame profile towards the interior.

16. The racket according to claim 1, wherein the frame profile comprises one or more strengthening layer(s) in the area around the at least one opening.

17. The racket according to claim 16, wherein the strengthening layer is arranged at an angle of ±45° with respect to the direction of the frame and is woven with a material selected from the group consisting of carbon fiber, glass or aramid and a unidirectional prepreg.

18. The racket according to claim 1, wherein in the area of the opening at least one trough-shaped depression is formed in the frame profile.

19. The racket according to claim 18, wherein two opposite trough-shaped depressions are formed at each opening.

20. The racket according to claim 1, wherein at least one opening is provided in the area between eight o'clock and ten o'clock on the racket head.

21. The racket according to claim 1, wherein the at least one opening is provided at about nine o'clock on the racket head.

22. A process for producing a racket, comprising the following steps:

(a) forming a frame comprising a hollow frame profile, a racket head and a handle portion connected to the frame; and (b) providing at least one opening extending through the hollow frame profile and oriented essentially perpendicular with respect to a stringing plane formed by the racket head, wherein at least one opening is formed by two opposite holes in the hollow frame profile.

23. The process according to claim 22, wherein at least two openings are provided essentially symmetrical with respect to a longitudinal axis of the racket.

24. The process according to claim 22, wherein the at least one opening is drilled, milled or sawed into the frame profile.

25. The process according to claim 22, wherein an essentially tubular insert is introduced in the at least one opening in order to close the frame profile towards the interior.

26. The process according to claim 22, wherein at least one strengthening layer is provided in the area around the at least one opening when the frame profile is formed.

* * * * *